US007743851B2

(12) United States Patent
Keskiniva et al.

(10) Patent No.: US 7,743,851 B2
(45) Date of Patent: Jun. 29, 2010

(54) METHOD AND ROCK DRILLING RIG FOR HOLE DRILLING

(75) Inventors: Markku Keskiniva, Ylöjärvi (FI); Mauri Esko, Ikaalinen (FI); Jorma Mäki, Mutala (FI); Aimo Helin, Tampere (FI); Juha Piispanen, Tampere (FI); Erkki Ahola, Kangasala (FI)

(73) Assignee: Sandvik Mining and Construction Oy, Tampere (FI)

( * ) Notice: Subject to any disclaimer, the term of this patent is extended or adjusted under 35 U.S.C. 154(b) by 45 days.

(21) Appl. No.: 12/083,083

(22) PCT Filed: Oct. 6, 2006

(86) PCT No.: PCT/FI2006/050431

§ 371 (c)(1),
(2), (4) Date: Apr. 4, 2008

(87) PCT Pub. No.: WO2007/042618

PCT Pub. Date: Apr. 19, 2007

(65) Prior Publication Data

US 2009/0065256 A1 Mar. 12, 2009

(30) Foreign Application Priority Data

Oct. 7, 2005 (FI) ..... 20055543

(51) Int. Cl.
*E21B 7/00* (2006.01)

(52) U.S. Cl. ..... 175/57

(58) Field of Classification Search ..... 175/19, 175/427, 293, 55, 56, 57; 173/200, 14, 201
See application file for complete search history.

(56) References Cited

U.S. PATENT DOCUMENTS

| | | | | |
|---|---|---|---|---|
| 2,717,763 | A | 9/1955 | Bodine | |
| 2,743,083 | A * | 4/1956 | Zublin | 175/56 |
| 3,307,641 | A | 3/1967 | Wiggins | |
| 3,377,902 | A * | 4/1968 | Bodenseher | 83/588 |
| 4,256,190 | A | 3/1981 | Bodine | |
| 5,662,180 | A * | 9/1997 | Coffman et al. | 175/57 |
| 7,341,116 | B2 * | 3/2008 | Fincher et al. | 175/57 |
| 2005/0178558 | A1 * | 8/2005 | Kolle et al. | 166/373 |

* cited by examiner

*Primary Examiner*—Jennifer H Gay
*Assistant Examiner*—James G Sayre
(74) *Attorney, Agent, or Firm*—Drinker Biddle & Reath LLP

(57) ABSTRACT

The invention relates to a method and a rock drilling rig for drilling a hole in a rock. In the method the hole is drilled with a so-called top-hammer rock drilling rig including a drill rod and a cone roller bit at the end of the drill rod. During drilling with the percussion device, stress pulses of low amplitude are produced at a high frequency of at least 200 Hz. In the rock drilling rig, the cone roller bit (3) at the end of the drill rod and the percussion device are configured to feed stress pulses of low amplitude, at the frequency of at least 200 Hz, via the drill rod and the cone roller bit to the rock.

12 Claims, 3 Drawing Sheets

METHOD AND ROCK DRILLING RIG FOR HOLE DRILLING

CROSS REFERENCE TO RELATED APPLICATIONS

This application is the National Stage of International Application No. PCT/FI2006/050431, filed Oct. 6, 2006, and claims benefit of Finnish Application No. 20055543, filed Oct. 7, 2005.

BACKGROUND OF THE INVENTION

The invention relates to a method for drilling a hole in rock with a top-hammer rock drilling rig comprising a rock drill, to which is attached a drill rod, at one end of which there is attached a drill bit, and which includes a percussion device and a rotation motor, in which method the drill rod and the drill bit are rotated with the rotation motor, and stress pulses are directed with the percussion device via the drill rod and the drill bit to the rock for breaking the rock. The invention further relates to a rock drilling rig for drilling a hole in rock, the rock drilling rig comprising a top-hammer rock drill, a drill rod attached thereto and a drill bit attached to the end of the drill rod, and the rock drill includes a percussion device for providing stress pulses via the drill rod and the drill bit to the rock and a rotation motor for rotating the drill rod and the drill bit.

When hard rock types are concerned, rock drilling is carried out with so-called top-hammer rock drilling rigs, which comprise a rock drill, a drill rod consisting of one or more interconnected parts attached thereto and a tool at the end of the drill rod, i.e. a drill bit. In known solutions, the drill bit has a fixed body in whose surface facing the direction of drilling there are embedded hard metal buttons which perform the actual rock breaking by the effect of a stress pulse from the percussion device. The known solutions have a drawback that rock breaking requires great forces, and therefore the hard metal buttons must be designed more in view of the duration of loading than efficient rock breaking. As the diameter of the hole increases the number of buttons breaking the bottom of the hole should also be increased. The increase in the number of buttons, in turn, makes it more difficult to design the drill bits, because the buttons are to be loaded in an even manner. The fact that, in practice, the buttons are loaded in a relatively uneven manner, decreases the drilling rate.

Further, it is also difficult to drill large holes, the maximum hole size being 5.5 to 6 inches, with top-hammer drilling rigs, because considerable problems already arise in drilling holes having a diameter of 5 inches. In the known top-hammer rock drilling rigs also the amount of energy required for rock breaking is very high, typically about 600 to 800 J. In current rigs, the hard metal buttons of the drill bits are subjected to extremely high strain. As the drill bits are pushed against the rock with great force and the buttons move sliding on the rock surface, the result is intense wear, which must also be taken into account in button shape design.

Large holes having a diameter of 8 to 10 inches are typically drilled with rotary drills operating without percussion and using drill bits provided with rotary cone roller bits. These have a problem that rock breaking requires extremely great static force, and consequently these so-called rotary drilling rigs are heavy and require sturdy bases.

BRIEF DESCRIPTION OF THE INVENTION

The object of the invention is to provide a method and apparatus for rock drilling, which allow more efficient drilling than before and which allow top-hammer rock drilling rigs to increase the size of a hole to be drilled economically and efficiently as compared with the currently possible size.

The method of the invention is characterized in that the drill bit used is a cone roller bit and that the percussion device provides stress pulses of low amplitude at a high frequency such that the load factor of the drill bit is at least 0.075.

The rock drilling rig of the invention is characterized in that the drill bit is a cone roller bit and that the percussion device is configured to provide stress pulses of low amplitude via the drill rod and the drill bit to the rock at a high frequency such that the load factor of the drill bit is at least 0.075.

The basic idea of the invention is that the top-hammer rock drilling rig uses a cone roller bit as the tool. Another basic idea of the invention is that the drilling employs low amplitude stress pulses which are produced at a high frequency such that the load factor of the drill bit is high, at least 0.075.

The invention has an advantage that the load on the buttons decreases as compared with the solutions currently used in top-hammer drilling. Likewise, feed force is significantly lower than the feed force currently required in rotary drilling. Because the amplitude of the stress pulse is low, the rod equipment used for drilling may be designed better in view of the parameters crucial to drilling, such as rigidity, flushing etc., now that the tension in the drill rod does not restrict the design. A further advantage is that the cone roller bit provides a symmetrical load, which is not often the case with a normal drill bit, in which the buttons on the frontal surface must be placed asymmetrically so as to enable efficient drilling. Yet another advantage is that, thanks to the rotary motion of the cone roller bit, drilling friction and tool wear are significantly lower than in currently available solutions.

BRIEF DESCRIPTION OF THE DRAWINGS

The invention will be described in greater detail in connection with the attached drawings, in which.

DETAILED DESCRIPTION OF SOME EMBODIMENTS OF THE INVENTION

Figure 1:
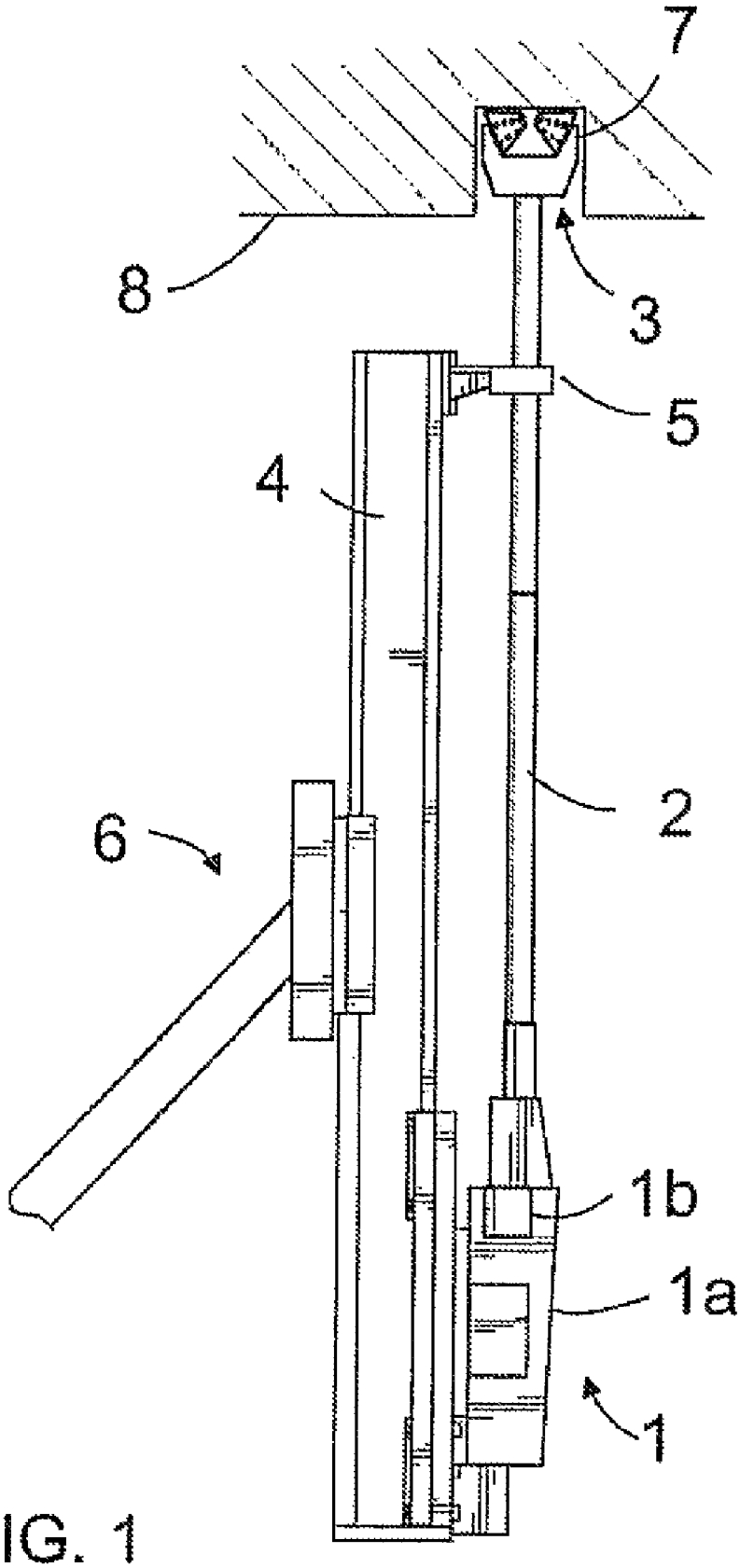
FIG. 1 is a schematic view of a rock drilling rig of the invention.

The figure shows a top-hammer rock drilling rig, which comprises a rock drill 1, a drill rod 2 attached to the rock drill and a cone roller bit 3 attached at the end of the drill rod. The rock drill 1 comprises a percussion device 1*a* and a rotation motor 1*b*. The percussion device 1*a* delivers impacts via the drill rod 2 to the cone roller bit 3, and correspondingly, the rotation motor 1*b* rotates the drill rod and the cone roller bit 3 therewith. Their structure and operation are known per se, and therefore they need not be described in greater detail.

Typically the percussion devices moves in a manner known per se and by means of feeding mechanisms known per se along a feed beam 4, at the end of which there is typically a drill guide 5 for guiding the drill rod and thus the drill bit during drilling. The feed beam 4, in turn, is typically connected with a boom 6 or the like to a base, not shown, of the drilling rig. These structures and the operation thereof are commonly known and apparent to a person skilled in the art, and therefore they need not be described in greater detail in this connection. In the course of drilling a hole 7 is typically produced in the rock 8.

In the rock drilling rig of the invention the percussion device 1*a* of the rock drill 1 produces stress pulses at a frequency of 200 to 1000 Hz to the drill rod 2 and therethrough to the drill bit and further to the rock to be drilled. When the drill bit is correspondingly rotated with the rotation motor 1*b*, for instance 250 to 300 rpm at the minimum, while drilling a hole of 100 mm in diameter, the cone roller bit 3 manages to turn such that on arrival of every stress pulse the buttons in contact with the rock are always on a position different from the one on arrival of the preceding stress pulse. The amplitude of the stress pulse to be fed to the cone roller bit is low, typically 100 MPa, 150 MPa at most. When only a few buttons of the cone roller bit, which typically includes three rotating cones provided with hard metal buttons, are in contact with the rock, it is possible to direct sufficient force to the rock via the buttons and thus get the rock broken. The required amount of energy per stress pulse is typically about ⅕ to 1/10 of the energy required in conventional rock drilling equipment, when a hole of a corresponding size is drilled. On the other hand, because in the cone roller bit 3 the hard metal buttons are not rubbed against the rock, but while rotating the bit makes the cone rollers rotate and the hard metal buttons against the rock change on a continuous basis due to rotation, the hard metal buttons need not be designed to resist great forces and hence they may be shaped to be efficient from the viewpoint of rock breaking. Due to the cone roller bit the necessary rotative moment is low, because there is no need to overcome sliding friction like in known solutions. The required feed force is relatively low and, nevertheless, as a result the rock breakage is very efficient.

Figure 2:
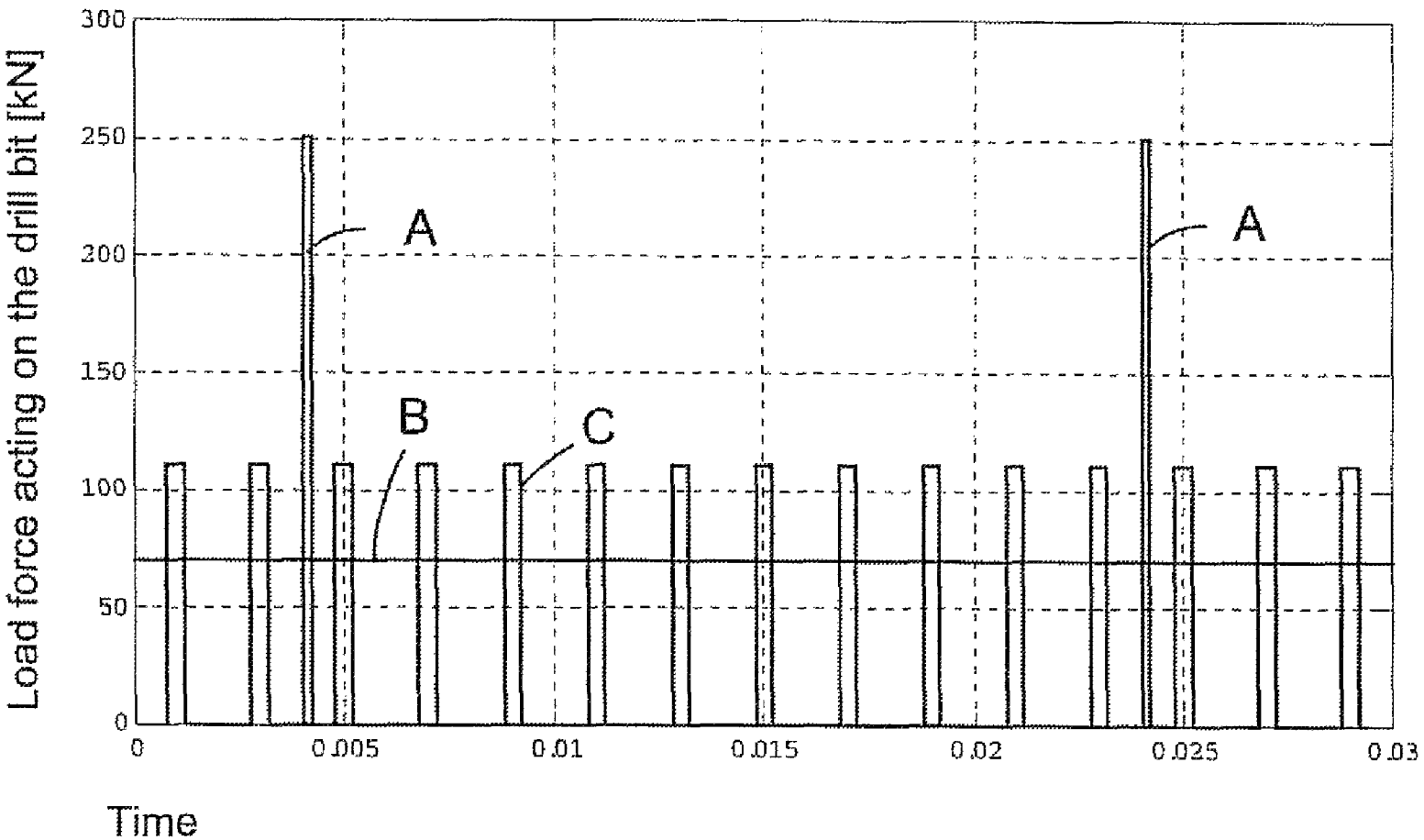
FIG. 2 shows schematically a force acting on a drill bit in a conventional top-hammer rock drilling rig, a so-called rotary drill and the rock drilling rig of the invention.

FIG. 2 shows schematically a force acting on the drill bit in a conventional top-hammer rock drill, a so-called rotary drill and the rock drilling rig of the invention using the method in accordance with the invention. The amplitude of stress pulses generated by the conventional top-hammer rock drill is high and the duration of the stress pulses is very short. In the case of FIG. 2, typical stress pulses of a conventional rock drill (e.g. frequency 50 Hz, pulse length 0.2 ms) produce a momentary load force of about 250 kN, whereby the total load factor (α) of the drill bit is about 0.01. These pulses are denoted with letter A.

The specification load factor (α) used in rock breaking determines how the rock to be broken will be loaded temporally. This can be expressed by formula $$\alpha = \frac{t_p}{T} = t_p f = \frac{L_p f}{c}. \quad (1)$$

where $t_p$ is the length of a stress pulse, f is frequency, $L_p$ is wave length and c is the speed of stress pulse in a tool. In current percussion devices a typical load factor α=0.01-0.025.

For instance, in percussion devices whose piston length is 0.5 m and frequency is 60 Hz, the load factor α is 0.012.

The method of the invention provides a considerably higher load factor, whereby

α=>0.075, preferably at least 0.1.

In theory, the maximum load factor is 1, but in practice it cannot be that. The device generating the stress wave spends some of the time for stress wave generation and some of the time for recovery, i.e. returning to the stress wave generation position. In practice, this means that because in actual fact the recovery speed cannot be higher than the stress wave generation speed, the maximum load factor is, in practice, about 0.5.

When the so-called rotary drill is used for drilling, the drill bit is continuously subjected to a static load (α~1), depicted by a horizontal line B. It is in the order of 70 kN, for instance.

In the conventional top-hammer rock drill, the conventional fixed drill bit must be primarily designed optimal for resisting the load force. This is the reason why both the shape and structure of the buttons and the structure of the drill bit must be designed, in practice, only that purpose in mind, because it is crucial for drilling that the drill bit lasts at least for a reasonable period of time. In normal rotary drilling performed by a cone roller bit high load resistance is not the main factor, because the load force is about ⅓ of the load force of the top-hammer rock drill with a fixed drill bit. Heavy equipment for providing a static load is necessary, instead.

Letter C denotes a situation created by means of the rock drilling rig in accordance with the present invention, i.e. the top-hammer rock drill provided with a cone roller bit (e.g. frequency 500 Hz, pulse length 0.4 ms). Here the load force is about 70% higher than in rotary drills but less than half of the load force provided by a conventional top-hammer rock drilling machine. The cone roller bit endures this kind of loading momentarily, whereby the use of high stress pulse frequency produces α load factor α of 0.1. As the stress pulse frequencies between the conventional top-hammer rock drilling machine and the rock drilling rig of the invention are compared, it appears from the figure that in the rock drilling rig and the method of the invention the stress pulse frequency may be up to more than ten times higher. The use of low amplitude, which is higher than the static value typically obtained by a rotary drill, and high frequency produce a high load factor α, which is as much as 10 to 200 times higher compared with the load factor produced in connection with a conventional top-hammer rock drilling machine provided with a fixed drill bit.

Figure 3:
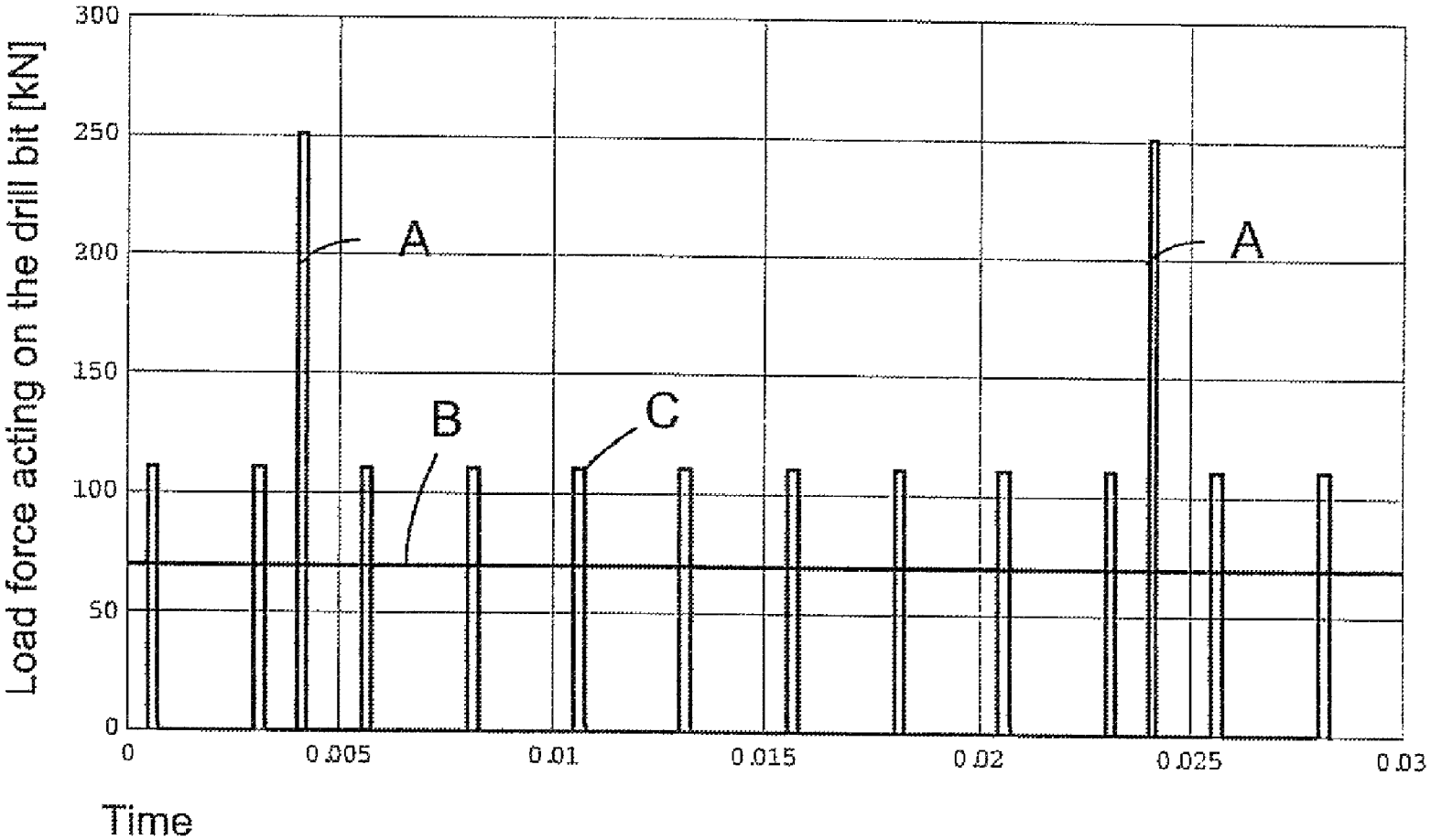
FIG. 3 shows schematically, similarly to FIG. 2, the same forces with different values.

FIG. 3 shows schematically, similarly to that in FIG. 2, a force acting on the drill bit in a conventional top-hammer rock drill, a so-called rotary drilling device and the rock drilling rig of the invention using the method in accordance with the invention. However, in this case the pulse values used in connection with the method of the invention are different, i.e. the frequency is 400 Hz and the pulse length is 0.25 ms, yet the amplitude of pulse is the same. The load factor α will then be 0.1.

In the experimental tests run for studying the operation of the method and the apparatus of the invention it was found that when using a pulse frequency of 200 to 1000 Hz it is advantageous to use a load ratio of 0.075-0.5. As the load ratio increases, the need for feed force increases considerably, which is not desirable.

The drawing and the relating specification are only intended to illustrate the inventive idea. The details of the invention may vary within the scope of the claims.

The invention claimed is:

1. A method for drilling a hole in a rock with a top-hammer rock drilling rig comprising a rock drill, to which is attached a drill rod, at one end of which there is attached a drill bit, and which includes a percussion device and a rotation motor, in which method the drill rod and the drill bit are rotated with the rotation motor, and stress pulses are directed with the percussion device via the drill rod and the drill bit to the rock for breaking the rock, wherein the drill bit is a cone roller bit and the percussion device generates stress pulses of low amplitude at a high frequency such that a load factor (α) of the drill bit is at least 0.075.

2. The method of claim 1, wherein the stress pulse frequency is at least 200 Hz.

3. The method of claim 1, wherein the amplitude of the stress pulses is 150 MPa.

4. A rock drilling rig for drilling a hole in a rock, the rock drilling rig comprising a top-hammer rock drill, a drill rod attached thereto and a drill bit attached to the end of the drill rod, and the rock drill comprises a percussion device for providing stress pulses via the drill rod and the drill bit to the rock and a rotation motor for rotating the drill rod and the drill bit, wherein the drill bit is a cone roller bit, the percussion device is configured to provide stress pulses of low amplitude via the drill rod and the drill bit to the rock at a high frequency such that a load factor ($\alpha$) of the drill bit is at least 0.075.

5. The rock drilling rig of claim 4, wherein the percussion device is configured to produce stress pulses at the frequency of at least 200 Hz.

6. The rock drilling rig of claim 4, wherein the percussion device is configured to produce stress pulses having the amplitude of 150 MPa.

7. The rock drilling rig of claim 6, wherein the percussion device is configured to produce stress pulses having the amplitude of 100 MPa.

8. The rock drilling rig of claim 5, wherein the percussion device is configured to produce stress pulses having the amplitude of 150 MPa.

9. The rock drilling rig of claim 8, wherein the percussion device is configured to produce stress pulses having the amplitude of 100 MPa.

10. The method of claim 3, wherein the amplitude of the stress pulses is 100 MPa.

11. The method of claim 2, wherein the amplitude of the stress pulses is 150 MPa.

12. The method of claim 11, wherein the amplitude of the stress pulses is 100 MPa.

* * * * *